United States Patent [19]

Edamura

[11] Patent Number: 4,816,635

[45] Date of Patent: Mar. 28, 1989

[54] MICROWAVE OVEN WITH REMOTE CONTROLLER

[75] Inventor: Kaoru Edamura, Nara, Japan

[73] Assignee: Sharp Kabushiki Kaisha, Osaka, Japan

[21] Appl. No.: 136,528

[22] Filed: Dec. 22, 1987

Related U.S. Application Data

[63] Continuation of Ser. No. 7,779, Jan. 28, 1987, abandoned.

[30] Foreign Application Priority Data

Jan. 28, 1986 [JP] Japan ..... 61-17290

[51] Int. Cl.[4] ..... H05B 6/68

[52] U.S. Cl. ..... 219/10.55 B; 219/489; 219/506; 99/325; 341/176

[58] Field of Search ..... 219/10.55 B, 10.55 R, 219/489, 490, 487, 506; 99/325; 235/462, 472; 340/825.1, 825.15, 696; 364/477

[56] References Cited

U.S. PATENT DOCUMENTS

| | | | |
|---|---|---|---|
| 4,131,786 | 12/1978 | Cooper | 219/10.55 B X |
| 4,323,773 | 4/1982 | Carpenter | 219/10.55 R X |
| 4,339,646 | 7/1982 | Doi et al. | 219/10.55 B |
| 4,340,797 | 7/1982 | Takano et al. | 219/10.55 B |
| 4,398,651 | 8/1983 | Kumpfer | 219/10.55 R X |

FOREIGN PATENT DOCUMENTS

| | | |
|---|---|---|
| 2060964 | 5/1981 | United Kingdom . |
| 2087614 | 5/1982 | United Kingdom . |

*Primary Examiner*—Philip H. Leung

*Attorney, Agent, or Firm*—Birch, Stewart, Kolasch & Birch

[57] ABSTRACT

A microwave oven has an oven main body with a built-in heater unit and a remote controller which includes a bar code reader for reading a bar code of mutually related multiple data, memory for storing a plural sets of the multiple data read by the bar code reader, a display device for displaying the multiple data; a transmitting device for sending to the oven main body the data selected from the plural sets of the multiple data stored in the memory; and a control unit for data selection and transmission.

4 Claims, 6 Drawing Sheets

MICROWAVE OVEN WITH REMOTE CONTROLLER

This application is a continuation of application Ser. No. 007,779 filed on Jan. 28, 1987, now abandoned.

BACKGROUND OF THE INVENTION

The present invention relates to a microwave oven with a remote controller, or more specifically to a microwave oven whose remote controller incorporates bar code reading means to process multiple data related to cooking.

Bar code reading systems which can input data properly in a moment by a simple operation have been well known and had wide range of applications including "POS System" in the industry.

Cooking in a microwave oven requires lot of information. Some microwave ovens use bar code readers to input necessary information; cooking program data in form of bar code symbols are read by the bar code reader for a microwave oven remote controller and supplied a wireless manner to the controller in the microwave oven main body.

An example of such a microwave oven is disclosed in U.S. patent application Ser. No. 855,496 filed by Kaoru EDAMURA under the title "ELECTRONICALLY CONTROLLED OVEN" now abandoned.

The microwave oven of the above application, however, only reads and supplies particular cooking program data to the oven main body. It is not provided with functions often demanded by users, that is, the function of reading information such as primary ingredients and time required for cooking (the sum of heating time and average time for preliminary arrangement for cooking) for each of various dishes, and the function of supplying the oven main body with the information selected according to the material and time actually available for cooking. In other words, the oven disclosed in the above application cannot play any role in planning a menu.

SUMMARY OF THE INVENTION

It is an object of the present invention to provide a microwave oven having a remote controller that stores information on a plurality of dishes, input from a bar code reader, and which selects a particular data according to the requirements of the user, helping the user with menu planning.

More specifically, the object of this invention is to provide a microwave oven controlled by a separate portable remote controller which reads dish data such as primary ingredients and cooking time requirement (the sum of heating time and average time for prearrangement) from a bar code and outputs the data to display means as required by the user, thus allowing the electronic oven to participate in menu planning and to handle necessary data very easily.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention comprises an oven main body containing a heater unit, and a remote controller for giving instructions to the oven on cooking operation from a remote place. The remote controller comprises means for reading bar codes comprising mutually related multiple data, memory means for storing plural sets of the multiple data read by the bar code reading means, means for displaying multiple data, transmission means for sending to the oven main body data selected from the plural sets of stored multiple data, and means for controlling data selection, cancellation and transmission.

Since any data stored can be displayed by operation of the control means for selection of necessary data from the plurality of sets of multiple data read from the bar code reading means and stored in the memory means, the microwave oven of the present invention helps the user plan a menu.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

An embodiment of the present invention is now described with reference to the drawings. It should be noted that the invention is not limited by the embodiment presented below.

Figure 1:
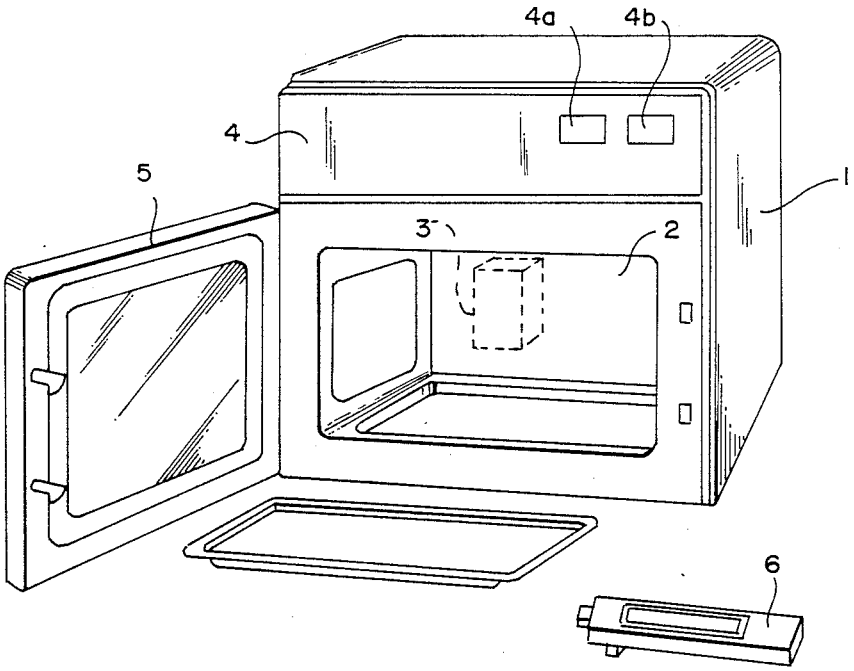
FIG. 1 is a perspective view of an embodiment of the present invention.

Referring to FIG. 1, an oven main body (1) comprises a heating chamber (2), a heater unit (3) composed of heating means such as a magnetron (not shown), and a control unit (4) provided to control the heater unit (3). An oven door (5) is provided on the front of the oven main body (1) to tightly close the heating chamber (2). A remote controller (6) sends or receives signals the form of infrared rays to a receiver (4*a*) or from a transmitter (4*b*) both mounted in the control unit (4) of the oven main body (1).

Figure 2:
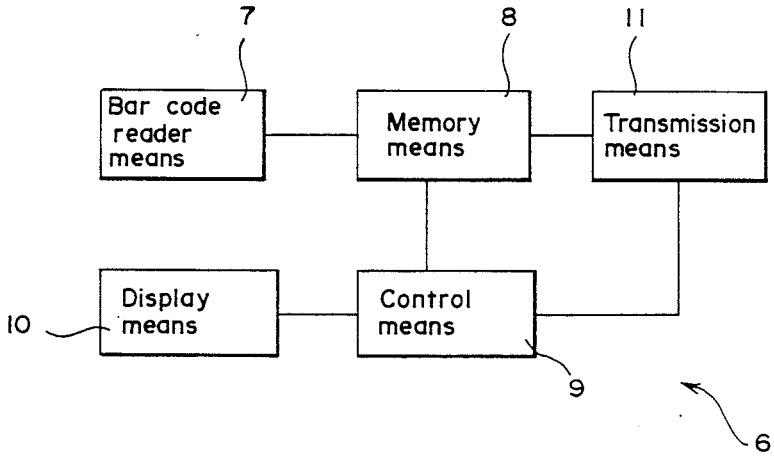
FIG. 2 is a block diagram of the remote controller of the embodiment.
Figure 4:
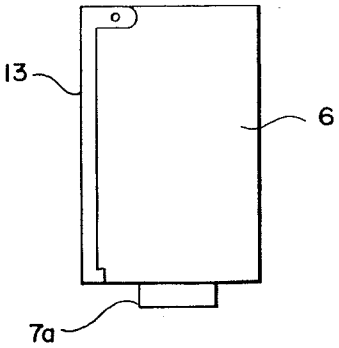
FIGS. 4A and 4B are a top view and a side view, respectively, of the remote controller.
Figure 3:
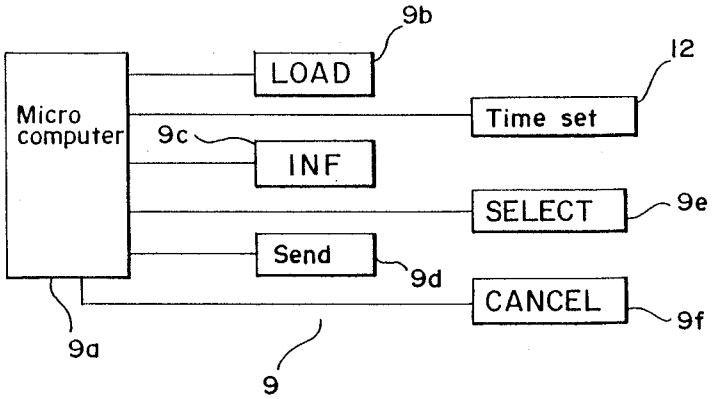
FIG. 3 is a block diagram of the control means.
Figure 4:
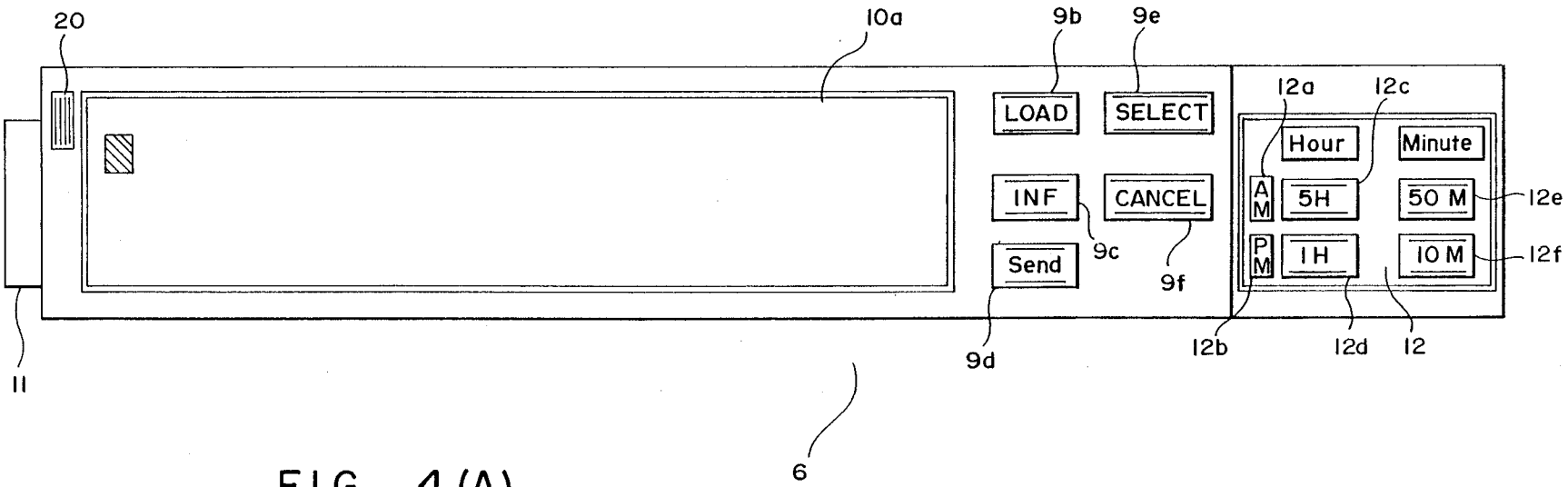

FIG. 2 is a block diagram of the remote controller (6). The remote controller (6) comprises means (7) for reading a bar code comprising mutually related multiple information such as program data, dish name and its primary ingredients, memory means (8) such as a RAM for storing the read multiple data, means (9) for controlling data selection and transmission, display means (10) for presenting displaying data selected by the control means (9) or data sequentially input to the remote controller (6), and transmission means (11) for sending to the control unit (4) the data selected from among plural sets of multiple data stored in the memory means (8). As shown in FIG. 3, the control means (9) comprises a micro computer (9*a*), a LOAD key switch (9*b*) for designated an operation mode of a microcomputer 9*a*, an information display (INF) key switch (9*c*), a send key switch (9*d*) for outputting signals to actuate the transmission means (11), a time set switch (12) for setting a desired time, a select key switch (9*e*) for sequentially designating addresses of the memory means (8) in outputting or inputting data, and a cancel key switch (9*f*) for deleting unnecessary data from the memory means (8). The bar code reading means (7) has a bar code reading section (7*a*) in the back of the remote controller (6) as shown in FIG. 4(B). When the bar code reading section (7*a*) traces a bar code symbol provided for each dish in a microwave oven cooking book, the bar code reading means (7) sends to the memory means (8) electric signals of the dish data. The display means (10) visually presents the read data, the data stored in the memory means (8) and the data transmitted from the control unit (4), on a display window (10*a*) provided on the front of the remote controller (6). A dot matrix LCD is the most suitable for the display means. The transmission means (11) converts the data electric signals into a transmission medium such as infrared rays. A sealing panel (13) constitutes a part of the exterior of the remote controller (6), openably covering a time set switch (12). It is usually closed to protect the time set switch (12) and conceal it from the user, making the construction of the remote controller (6) look simple.

Now, the operation of the embodiment is described in terms of the operation sequence, with reference to FIGS. 5 through 8.

Figure 5:
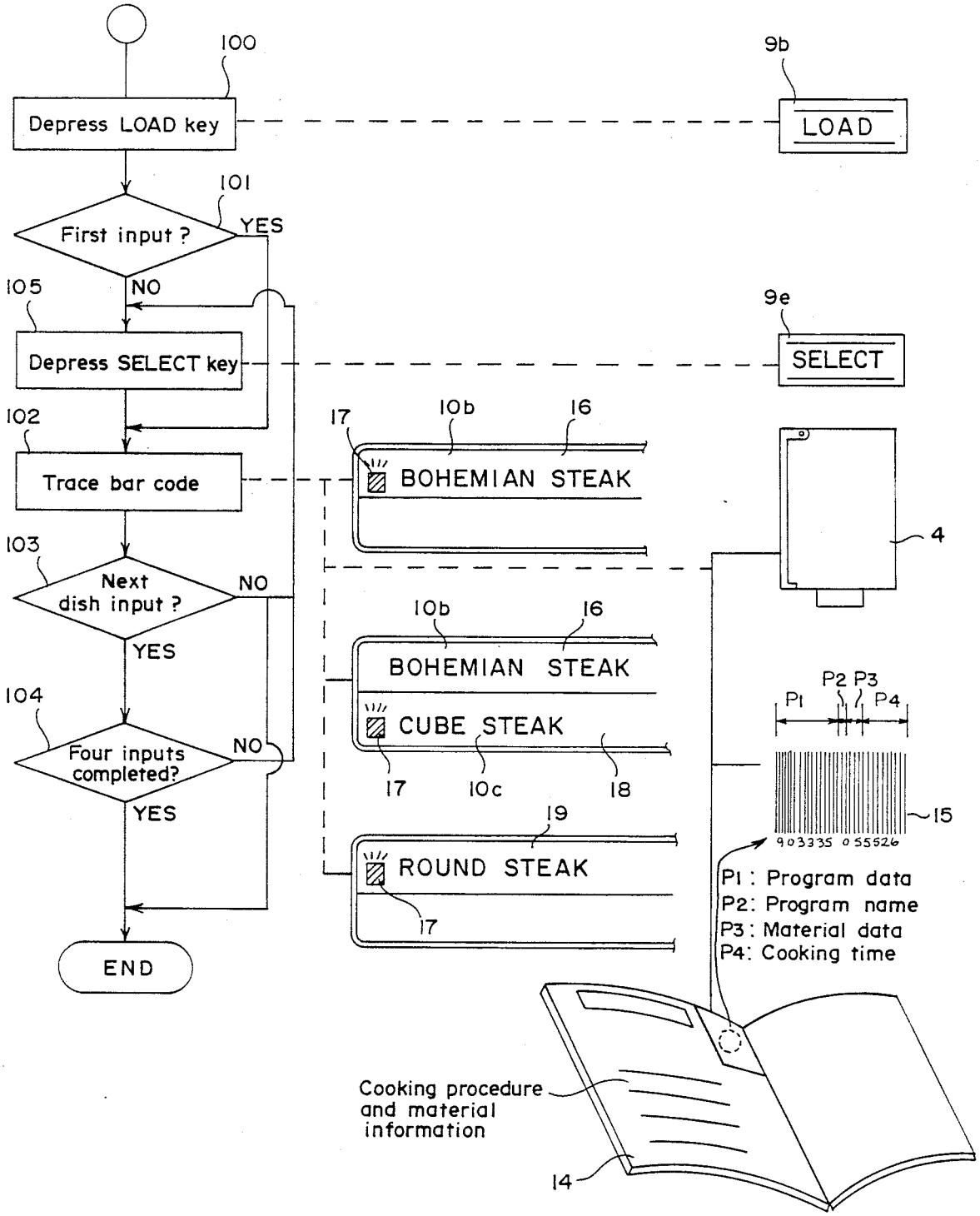
FIGS. 5 through 8 are flow charts for explaining the operation sequences of the remote controller.

FIG. 5 shows a flow chart of the operation sequence for inputting a plurality of dish data successively (Case 1). (In this embodiment, it is assumed that up to four dish data can be input successively.)

First, the LOAD key switch (9*b*) is operated (depressed) (Step 100). This operation sets the micro computer (9*a*) in the bar code symbol reading mode. If it is the first input operation (Step 101), a bar code symbol (15) is traced on a cook book (14) which introduces cooking procedures, ingredients and other information of dishes (Step 102). Each bar code symbol comprises four blocks P1 through P4: the block P1 for program-related data, P2 following P1 for the dish name, P3 following P2 for ingredients and P4 for time required for cooking the dish (the sum of heating time and average time for preliminary arrangement). The program-related data may be any one of a program-specifying code, a program itself or an address where the appropriate program is stored. When a bar code symbol is traced, the read dish name (16) such as "BOHEMIAN STEAK" appears on the display window (10*a*) with a symbol (17) blinking at the beginning of the dish name. If input is to be made for the next dish (Step 103), the select key switch (9*e*) is depressed (Step 105) to designate the next address unless four inputs have already been made. Then the dish name (16) of the last input is displayed in the upper half zone (10*b*) of the display window (10*a*) and the dish name (18) of the new input displayed in the lower half zone (10*c*). The symbol (17) blinks at the beginning of the newly input dish name (18). Thus, while the names of two dishes (16) and (18) are displayed simultaneously, the symbol (17) helps identify which of the two dishes is input later. The select key switch (9*e*) is depressed for each input until data of four dishes have been input. When the third input operation is completed, the dish names (16) and (18) of the first and second inputs disappear, and the dish name (19) of the third input is displayed with the symbol (17) blinking at the front in the upper half zone (10*b*) of the display window (10*a*).

Figure 6:
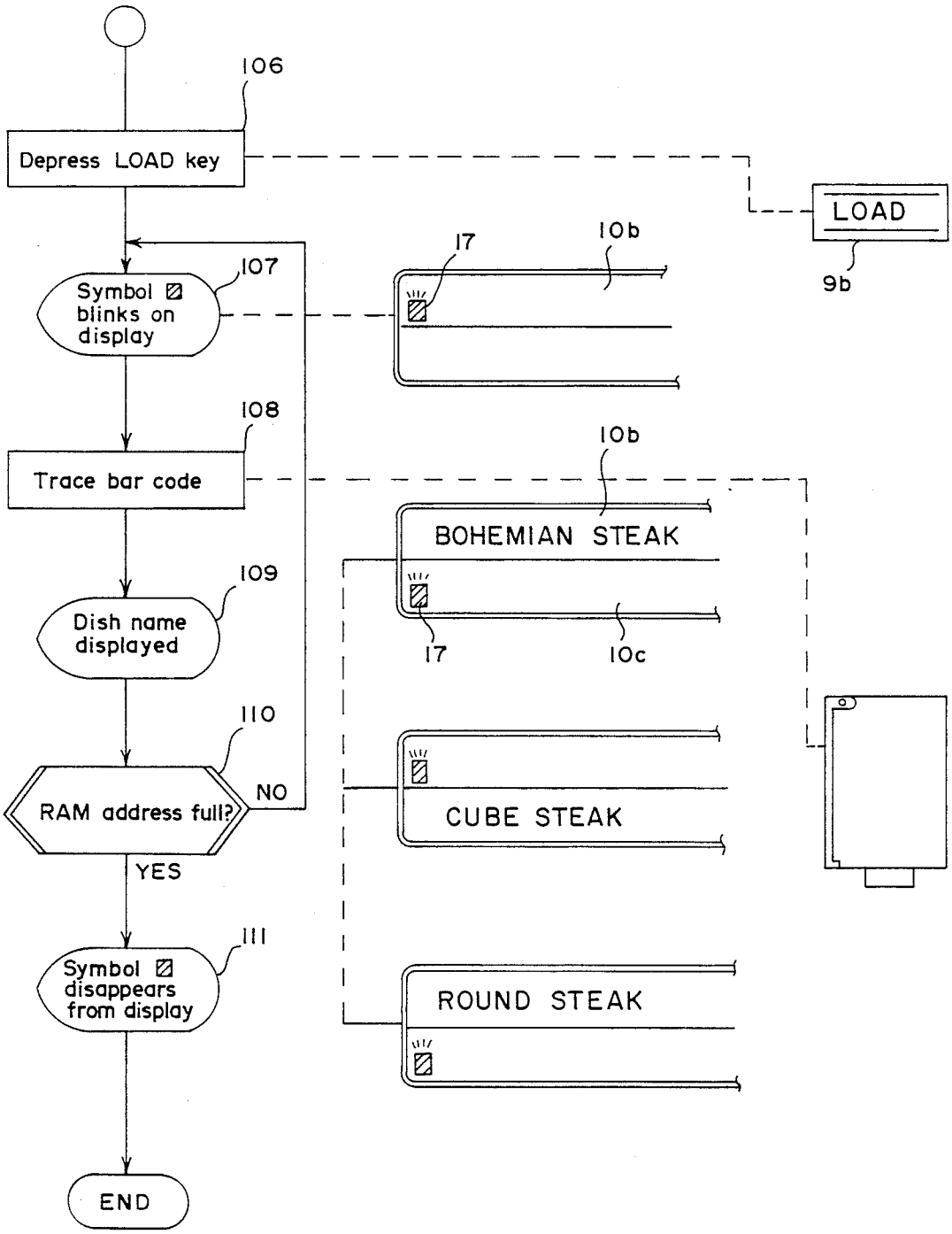

FIG. 6 shows the operation sequence for continuous input in which the micro computer (9*a*) designates the next address (updating) each time a bar code symbol (15) has been read (traced for input) (Case 2).

As in the Case 1, the LOAD key switch (9*b*) is depressed first (Step 106). This operation sets the micro computer (9*a*) in the reading mode so that input control is executed. Then a symbol (17) blinks in the upper half zone (10*b*) of the display window (10*a*) (Step 107), demanding the user to input data. When the user traces a bar code symbol (Step 108), the dish name (16) alone of the multiple data input is automatically output to the display window (10*a*) (Step 109), enabling the user to confirm the input data content. At this stage, the symbol (17) moves to the left end of the lower half zone (10*c*) of the display window (10*a*), urging the user to conduct the next input operation. At the end of the second input, the micro computer (9*a*), after making sure that some addresses still remain unoccupied in the memory means (8) (Step 110), deletes the dish name (16) of the first input and moves the symbol (17) to the left end of the upper half zone (10*b*) of the display window (10*a*), demanding the next input operation. The lower half zone (10*c*) of the display window (10*a*) presents the dish name (18) of the second input. The third and fourth inputs are made in the same sequence. When all the addresses provided for storing input data (four addresses in this embodiment) become full by the fourth input, the symbol (17) disappears (Step 111), indicating that no more input is acceptable.

Figure 7:
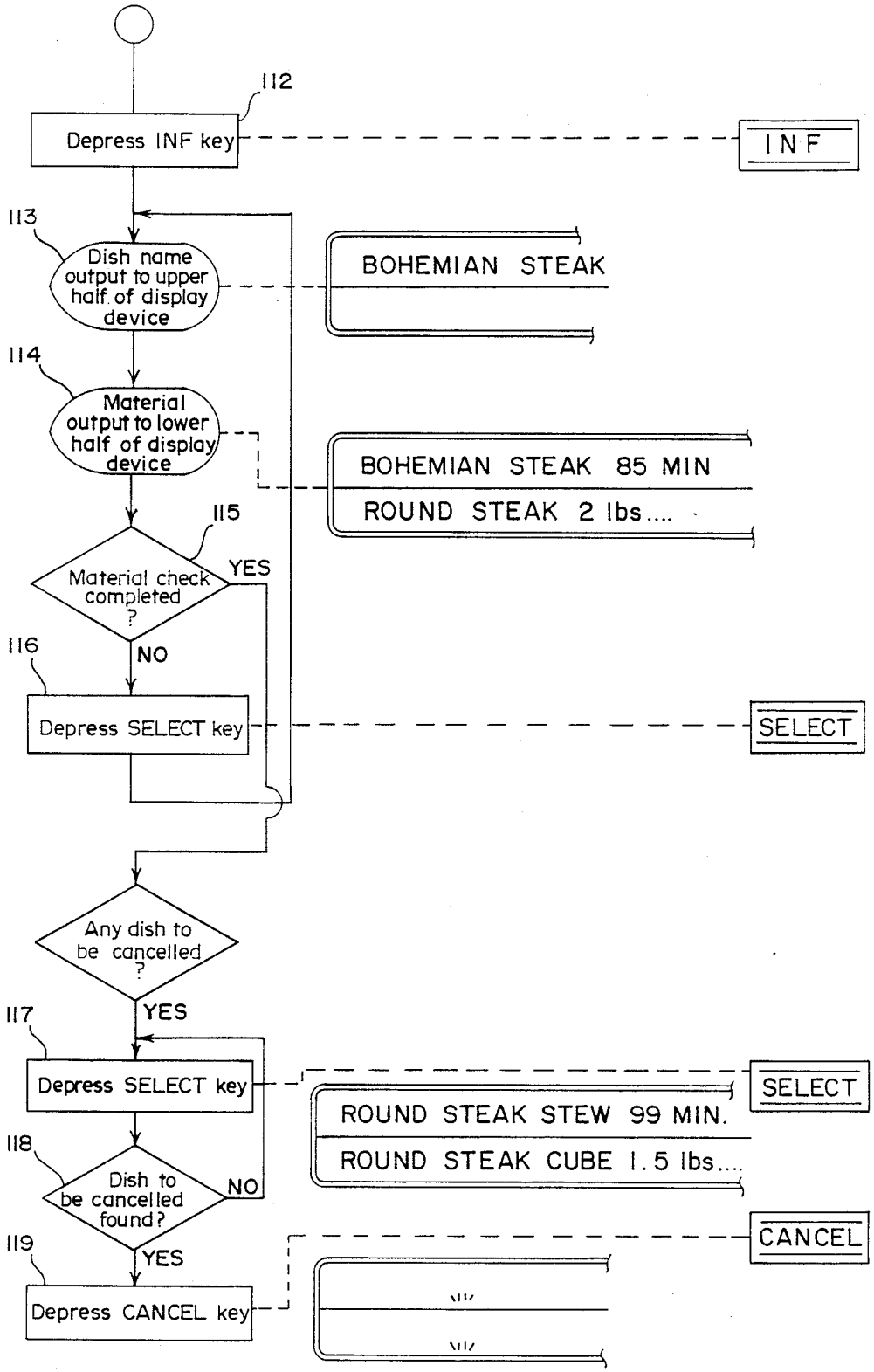

FIG. 7 shows a flow chart of operations for outputting to the display means (10) the material information of a dish, that is, the name and quantity of primary ingredients used in the dish and, for cancelling unnecessary information from the memory means (8).

The information display key switch (INF key) (9*c*) is depressed first (Step 112) for access to the first address. The content of the address or dish-related information is presented on the display window (10*a*); the dish name in the upper half zone (10*b*) and the name and quantity of primary material and the time required for cooking the dish (the sum of heating time and average time for pre-arrangement) in the lower half zone (10*c*) (Steps 113 and 114). After confirmation of the display (Step 115), the select key switch (9*e*) is depressed (Step 116) if the second dish-related data is to be checked. Access is then made to the second address to display the content. The data in the first address is displayed again by depressing the select key switch (9*e*) three times. Thus, reference data for dishes stored in the addresses of the memory means (8) are sequentially accessible by operation of the select key switch (9*e*).

In the course of sequentially checking dish-related data, if it is found that a particular data should be eliminated in view of material availability or cooking time requirement (the sum of heating time and average time for pre-arrangement), the select key switch (9*e*) is depressed (Step 117) for access to the address where the dish data to be eliminated is stored (Step 118), to cancel the dish. After the dish name is displayed, the cancel key switch 9*f* is depressed to cancel the dish related data.

Carrying the remote controller (6) to the market, the user can conduct the above operation as he or she makes a purchase, which reduces the time required for preparing a meal.

To save the user's time, the remote controller (6) is provided with an alarm feature which, if the time to start preparing a dish has been set in advance on the basis of the time requirement shown on the display window, actuates an electronic buzzer (20) to sound an alarm and outputs an alarm message to the display means (10) when the set time elapses.

Figure 8:
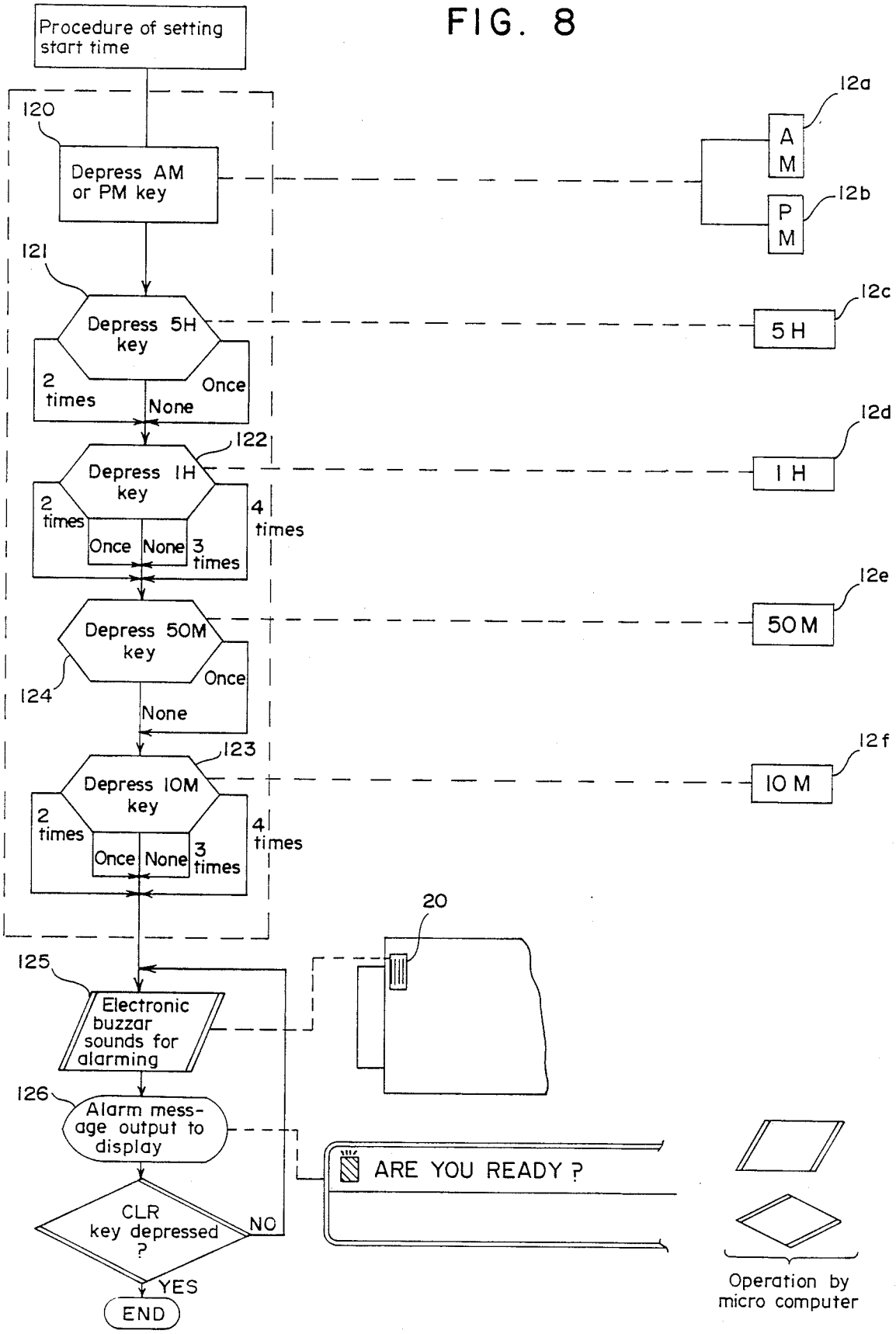

FIG. 8 shows the operation procedure for inputting the time to start preparing a dish.

Since the time set switch (12) is normally concealed behind the sealing panel (13), it is necessary to open the sealing panel (13) first. An AM key (12*a*) or a PM key (12*b*) is depressed depending whether the time to start cooking is in the morning or in the afternoon (Step 120). The hour of the time is set by using a 5-hour set key (12*c*) and a 1-hour set key (12*d*) which are both step key switches. Each depression of the 5-hour set key (12*c*) increments five hours, and each depression of the 1-hour set key (12*d*) increments one hour. The minute is set by using a 50-minute set key (12*e*) and a 10-minute set key (12*f*). Assuming 12:30 is to be set, for example, 12 hours is input by depressing the 5-hour set key (12*d*) two times (Step 121) and the 1-hour set key (12*d*) two times (Step 122), and 30 minutes is input by depressing the 10-minute set key (12*f*) three times (Step 123). To input 50 minutes, the 50-minute set key (12*e*) should be used (Step 124). By the above key operation, the micro computer (9*a*) receives input instructions (the results of addition in units of hour and minute) from the keys (12*a*) through (12*f*). In the above key operation, operations of the keys (12*a*) through (12*f*) are combined so that the time can be set by the minimum number of key depressions.

When the time set the above operation has elapsed, the electronic buzzer (20) sounds an alarm (Step 125) and the display means (10) displays a message such as "ARE YOUR READY?" (Step 126) to draw attention of the user.

Finally transmission of program data is described.

Depression of the send key switch (9*d*) causes the micro computer (9*a*) to designate the transmission mode. The select key switch (9*e*) is then depressed repeatedly until a desired dish name is displayed. This operation allows sequential access to the addresses storing program data and dish names in the memory means (8), so that the desired dish name can be selected. When the desired dish name is displayed, the send key switch (9*d*) is depressed again to actuate the transmission means (11) to start sending signals.

The memory means (8) may be of a type integral with the micro computer (9*a*), such as a RAM built in a single chip computer.

The microwave oven achieved by the present invention provides the following benefits to users:

(I) Mutually related multiple information such as program data and reference data for each of a number of various dishes is input all at once to the remote controller simply by tracing a bar code symbol.

(II) The reference data input can be confirmed on the display means provided in the remote controller, by simple operation.

(III) The remote controller, which is a vital part of the present invention, provides a data bank function. Specifically, the remote controller stores necessary information on a plurality of dishes picked up from among various dishes introduced in a cook book. Carrying the remote controller to the market, the user can consult the reference data such as names and quantities of primary ingredients of the dishes as well as the time required for preparing the dishes (the sum of heating time and average time required for prearrangement) by outputting them on the display window. Therefore, the remote controller serves as a shopping memo, permitting the user to select the most suitable dish from among the plurality of candidates according to availability of ingredients and time allowance.

The remote controller used in the microwave oven of the present invention assists the user not only in preparing dishes but also in planning a menu, so that the most optimum cooking operation as desired by the user can be realized.

While only certain embodiments of the present invention have been described, it will be apparent to those skilled in the art that various changes and modifications may be made therein without departing from the spirit and scope of the present invention as claimed.

What is claimed is:

1. A remote controller of a microwave oven and which is easily transportable by a user to a marketplace, comprising:

bar code reader means for reading a bar code containing recipe data including the dish name, quantity of the required ingredients and cooking procedures therefor;

memory means coupled to the bar code reader means for storing a plurality of recipes comprised of plural sets of multiple data read by said bar code reader means;

display means coupled to the memory means for displaying selected data stored in said memory means including data usable while at the marketplace for operation as a shopping memo by the user;

means coupled to the memory means for selecting and cancelling a particular recipe stored in said memory means;

wireless transmission means coupled to the memory means for transmitting selected recipe data on demand to a microwave oven; and user control means coupled to the display means, the selecting and cancelling means and the wireless transmission means for controlling the operation of said display means, selecting and cancelling means and wireless transmission means.

2. The remote controller as defined in claim 1, wherein said memory means comprises a random access memory (RAM).

3. The remote controller as defined in claim 1, wherein said wireless transmission means comprises infrared ray transmission means.

4. The remote controller as defined in claim 1, wherein said plurality of recipes comprises four recipes.

* * * * *